US010222055B2

(12) United States Patent
Pan et al.

(10) Patent No.: US 10,222,055 B2
(45) Date of Patent: Mar. 5, 2019

(54) REFRIGERATION APPARATUS AND LUMINOUS SHELF ASSEMBLY THEREFOR

(71) Applicants: HEFEI HUALING CO., LTD., Hefei, Anhui (CN); HEFEI MIDEA REFRIGERATOR CO., LTD., Hefei, Anhui (CN)

(72) Inventors: Shuwei Pan, Anhui (CN); Xianzhong Zhang, Anhui (CN); Juzhong Pan, Anhui (CN); Zhengguang Lv, Anhui (CN)

(73) Assignees: HEFEI HUALING CO., LTD., Hefei, Anhui (CN); HEFEI MIDEA REFRIGERATOR CO., LTD., Hefei, Anhui (CN)

( * ) Notice: Subject to any disclaimer, the term of this patent is extended or adjusted under 35 U.S.C. 154(b) by 39 days.

(21) Appl. No.: 15/105,865

(22) PCT Filed: Dec. 17, 2013

(86) PCT No.: PCT/CN2013/089683
§ 371 (c)(1),
(2) Date: Jun. 17, 2016

(87) PCT Pub. No.: WO2015/089734
PCT Pub. Date: Jun. 25, 2015

(65) Prior Publication Data
US 2016/0327259 A1 Nov. 10, 2016

(51) Int. Cl.
*F21V 33/00* (2006.01)
*F21V 3/04* (2018.01)
(Continued)

(52) U.S. Cl.
CPC ..... *F21V 33/0044* (2013.01); *F21S 4/28* (2016.01); *F21V 3/049* (2013.01); *F21V 23/001* (2013.01);
(Continued)

(58) Field of Classification Search
CPC ..... F21V 33/00; F21V 33/0044; A47B 2210/175; F25D 2325/021;
(Continued)

(56) References Cited

U.S. PATENT DOCUMENTS 5,836,669 A * 11/1998 Hed ..... G02B 6/0006 362/23.13
6,578,979 B2 * 6/2003 Truttmann-Battig ... F21S 6/005 362/238
(Continued)

FOREIGN PATENT DOCUMENTS

CN 101802531 A 8/2010
CN 202216484 U 5/2012
(Continued)

OTHER PUBLICATIONS

China Patent Office, Office action dated Apr. 27, 2017.
(Continued)

*Primary Examiner* — Daniel I Walsh
(74) *Attorney, Agent, or Firm* — Houtteman Law LLC

(57) ABSTRACT

A refrigeration apparatus and a luminous shelf assembly therefor are provided. The luminous shelf assembly includes: two electrical conductive elements extending along a vertical direction, each electrical conductive element having at least one electrical conductive bar; a shelf comprising a glass plate and a rear decoration strip, the rear decoration strip having an accommodating cavity which has an open rear side and a front side wall being provided with a plurality of light holes; an LED light bar having a plurality
(Continued)

of LED lights corresponding to the plurality of light holes respectively, and the LED light bar being accommodated in the accommodating cavity and having a positive power line and a negative power line respectively extending outwards from two ends of its own; and two energizing sub-assemblies connected to the two ends of the LED light bar and connected with the positive power line and the negative power line respectively.

16 Claims, 8 Drawing Sheets

(51) Int. Cl.

| | |
|---|---|
| ***F21V 23/00*** | (2015.01) |
| ***F21V 23/04*** | (2006.01) |
| ***F21V 23/02*** | (2006.01) |
| ***F21V 31/00*** | (2006.01) |
| ***F25D 25/02*** | (2006.01) |
| ***F25D 27/00*** | (2006.01) |
| ***F21S 4/28*** | (2016.01) |
| *F21W 131/301* | (2006.01) |
| *F21W 131/305* | (2006.01) |
| *F21Y 103/10* | (2016.01) |

(52) U.S. Cl.
CPC ..... *F21V 23/02* (2013.01); *F21V 23/04* (2013.01); *F21V 31/005* (2013.01); *F25D 25/02* (2013.01); *F25D 27/00* (2013.01); *F21W 2131/301* (2013.01); *F21W 2131/305* (2013.01); *F21Y 2103/10* (2016.08); *F25D 2325/022* (2013.01)

(58) Field of Classification Search
CPC ..... F25D 2325/022; F25D 27/00; F25D 2327/00; G02B 6/0095
See application file for complete search history.

(56) References Cited

U.S. PATENT DOCUMENTS 7,163,305 B2 * 1/2007 Bienick ..... A47B 97/00 362/125
7,413,321 B2 * 8/2008 Kim ..... G09F 13/18 362/127
8,322,873 B2 * 12/2012 Glovatsky ..... F25D 27/00 362/23.16
8,944,621 B2 * 2/2015 Driver ..... A47B 57/42 362/249.05
2003/0038571 A1 * 2/2003 Obrock ..... C03B 23/033 312/408
2004/0031234 A1 * 2/2004 Emde ..... F21S 11/00 52/786.11
2004/0196645 A1 * 10/2004 Allinson ..... G02B 6/0036 362/613
2004/0264160 A1 * 12/2004 Bienick ..... A47B 97/00 362/602
2007/0127229 A1 * 6/2007 Lee ..... F25D 25/02 362/92
2007/0139909 A1 * 6/2007 Wing ..... F25D 27/00 362/92
2008/0158858 A1 * 7/2008 Madireddi ..... A47F 3/001 362/92
2009/0021927 A1 * 1/2009 Hall ..... F25D 25/02 362/92
2009/0052161 A1 * 2/2009 Lee ..... F25D 27/00 362/94
2010/0097780 A1 * 4/2010 Beatenbough ..... A47F 3/001 362/92
2010/0180615 A1 * 7/2010 Linder ..... A47F 3/0434 62/248
2011/0164399 A1 * 7/2011 Driver ..... A47B 57/42 362/92
2012/0051030 A1 * 3/2012 Johnson ..... F25D 17/042 362/92
2013/0088136 A1 * 4/2013 Bassi ..... F25D 25/02 312/408
2013/0182422 A1 * 7/2013 Guilmette ..... F21V 21/00 362/184
2014/0268862 A1 * 9/2014 Gooden ..... F25D 27/00 362/555
2014/0376213 A1 * 12/2014 Miedema ..... F21V 33/0024 362/127
2015/0023000 A1 * 1/2015 Kendall ..... F25D 25/02 362/92
2015/0077985 A1 * 3/2015 Wang ..... F21S 4/28 362/231
2015/0241119 A1 * 8/2015 Sankhgond ..... F25D 25/025 312/114
2016/0161669 A1 * 6/2016 Lee ..... F25D 25/02 362/621
2016/0327259 A1 * 11/2016 Pan ..... F21V 33/0044

FOREIGN PATENT DOCUMENTS

CN 202813964 U 3/2013
CN 103615862 A 3/2014
CN 103615863 A 3/2014
CN 103644700 A 3/2014
CN 103673492 A 3/2014
CN 103673493 A 3/2014
CN 203657350 U 6/2014
CN 203719313 U 7/2014
CN 203719314 U 7/2014
CN 203719315 U 7/2014
CN 203719316 U 7/2014
CN 203719317 U 7/2014
CN 203719318 U 7/2014
CN 203771890 U 8/2014

OTHER PUBLICATIONS

International search report and written opinions for PCT application CN2013089683 dated Sep. 19, 2014.
English translation of international search report and written opinions for PCT application CN2013089683 dated Sep. 19, 2014.

* cited by examiner

REFRIGERATION APPARATUS AND LUMINOUS SHELF ASSEMBLY THEREFOR

FIELD

The present invention relates to a field of a refrigeration apparatus, especially relates to a luminous shelf assembly for a refrigeration apparatus and a refrigeration apparatus having the same.

BACKGROUND

A traditional refrigerator is only provided with a top light or a side light, and if there are too many things stored in a refrigerator compartment, an illumination intensity on a middle area in the refrigerator body will be insufficient due to being covered, especially middle and rear areas of glass plates in middle and lower layers as well as fruit and vegetable boxes will be lack of illumination.

SUMMARY

The present invention aims to solve one of the technical problems existing in the related art. Thus, one objective of the present invention is to provide a luminous shelf assembly having a simple structure and sufficient illumination intensity.

Another objective of the present invention is to provide a refrigeration apparatus having the luminous shelf assembly.

The luminous shelf assembly for the refrigeration apparatus according to embodiments of a first aspect of the present invention includes two electrical conductive elements extending along a vertical direction, each of the two electrical conductive elements having at least one electrical conductive bar perpendicular thereto and extending towards the other electrical conductive element, and the two electrical conductive elements being connected with a positive pole and a negative pole of a power source respectively; a shelf including a glass plate and a rear decoration strip disposed at a rear side of the glass plate, the rear decoration strip having an accommodating cavity therein, the accommodating cavity having an open rear side, and a front side wall of the accommodating cavity being provided with a plurality of light holes distributed and spaced apart from one another; an LED light bar having a plurality of LED lights corresponding to the plurality of light holes respectively, and the LED light bar being accommodated in the accommodating cavity and having a positive power line and a negative power line respectively extending outwards from two ends of the LED light bar; and two energizing assemblies connected to the two ends of the LED light bar and connected with the positive power line and the negative power line respectively, and the energizing assemblies being configured to electrically connect the positive power line and the negative power line with two electrical conductive bars corresponding to the positive power line and the negative power line in position, respectively.

With the luminous shelf assembly according to embodiments of the present invention, an entire area of the shelf can be illuminated, and the shelf assembly has a simple structure, a convenient installation and a low cost. In addition, when the luminous shelf assembly according to the present invention is used in a refrigeration apparatus, the shelf may be conducted with the power source for any pair of the electrical conductive elements to obtain a power source supply, and thus the shelf can be lighted up in any position, which is simple and convenient and provides more sufficient illumination.

According to an embodiment of the present invention, the LED light bar is packaged in the accommodating cavity of the rear decoration strip through a transparent packaging piece, thus improving a water resistance and a corrosion resistance of the luminous shelf assembly.

Optionally, the transparent packaging piece is made from epoxy resin.

According to an embodiment of the present invention, the plurality of LED lights extends out from the plurality of light holes and is attached to a rear surface of the glass plate respectively.

According to an embodiment of the present invention, the glass plate is provided with a silk-screen layer at a lower surface thereof and the silk-screen layer has a white or colorful pattern thereon.

Accordingly, light rays enter the glass plate from the rear side of the glass plate and finally are shined out of a front side of the glass plate after being reflected and refracted repeatedly. In a process of reflections and refractions, the light rays are transmitted out from the silk-screen layer, thus creating a luminous effect of the silk-screened surface; in addition, a problem of users' fingerprints contaminating the surface of the glass plate is avoided.

Optionally, the silk-screen layer is formed by a light-diffusion pigment being silk-screened on the lower surface of the glass plate.

Optionally, the silk-screen layer is configured to have a shape of a plurality of grids silk-screened on the lower surface of the glass plate.

Optionally, at least one surface of the glass plate is etched into a frosted surface.

Since a super white glass plate has very few metal ions therein, a light transmittance of the super white glass plate is high, and the light rays have very little attenuation in the glass plate. If the light-diffusion pigment is silk-screened on the lower surface of the glass plate or one or two surfaces of the glass plate are etched into one or two frosted surfaces, the light rays refracted within the glass plate can be scattered out relatively uniformly. In addition, after a frosting treatment is performed on an entire surface of the glass plate, even though the glass plate is contaminated with fingerprints, dust or other stains, it is difficult to realize by naked eyes, thus improving aesthetics of the appearance.

According to an embodiment of the present invention, a front end of the rear decoration strip has a first accommodating groove configured to accommodate a rear end of the glass plate.

According to an embodiment of the present invention, the shelf further includes a front decoration strip disposed at the front side of the glass plate.

Optionally, a rear end of the front decoration strip has a second accommodating groove configured to accommodate a front end of the glass plate.

According to an embodiment of the present invention, the shelf further includes at least one of a left decoration strip disposed at a left side of the glass plate and a right decoration strip disposed at a right side of the glass plate.

According to an embodiment of the present invention, the electrical conductive element is configured as an electrical conductive post or an electrical conductive line.

According to an embodiment of the present invention, each of lower surfaces of left and right ends of the rear decoration strip has a post hole, and the post hole has an upper end communicating with the accommodating cavity.

Each energizing sub-assembly includes a spring accommodated in the post hole and having an upper end abutting against a top wall of the accommodating cavity, and the spring being connected with the positive power line or the negative power line located at a corresponding end; and a touch bead accommodated in the post hole, the post hole having a necking portion at a lower end thereof, and a diameter of the necking portion being less than a diameter of the touch bead so that the spring abuts between the necking portion and the top wall of the accommodating cavity.

Thus, when the energizing sub-assembly electrically touches the electrical conductive bar on the electrical conductive element, the electrical conductive bar presses the touch bead into the post hole, and due to a function of the spring, a pressure exists between the touch bead and the electrical conductive bar, and thus a reliable electric connection is guaranteed.

Optionally, the touch bead is a stainless steel bead, a copper ball or a silver-plated steel ball.

The refrigeration apparatus according to embodiments of a second aspect of the present invention includes the luminous shelf assembly according to embodiments of the first aspect of the present invention; a box-shaped inner container, the luminous shelf assembly being disposed in the box-shaped inner container, a left side wall and a right side wall of the box-shaped inner container being provided with at least one pair of rib grooves, the least one pair of rib grooves being spaced apart from one another in an up and down direction, and each rib groove extending from front to rear, in which the two electrical conductive elements of the luminous shelf assembly are disposed at a left end and a right end of a rear side of the box-shaped inner container and extend along a vertical direction, a position of the at least one electrical conductive bar corresponds to the at least one pair of rib grooves respectively, and the positive power line and the negative power line of the LED light bar are electrically connected with corresponding electrical conductive bars respectively when the shelf is located in corresponding rib grooves; and a door body pivotable with respect to the box-shaped inner container so as to open and close.

Optionally, the electrical conductive element is a metal electrical conductive post pre-embedded in the box-shaped inner container.

Optionally, the power source for the electrical conductive element is controlled by a door light switch connected to the door body.

Optionally, the refrigeration apparatus is a refrigerator or a wine cabinet.

Additional aspects and advantages of the present invention will be given in part in the following descriptions, become apparent in part from the following descriptions, or be learned from the practice of the present invention.

BRIEF DESCRIPTION OF THE DRAWINGS

These and other aspects and advantages of the present invention will become apparent and more readily appreciated from the following descriptions on the embodiments taken in conjunction with the drawings in which.

Figure 1:
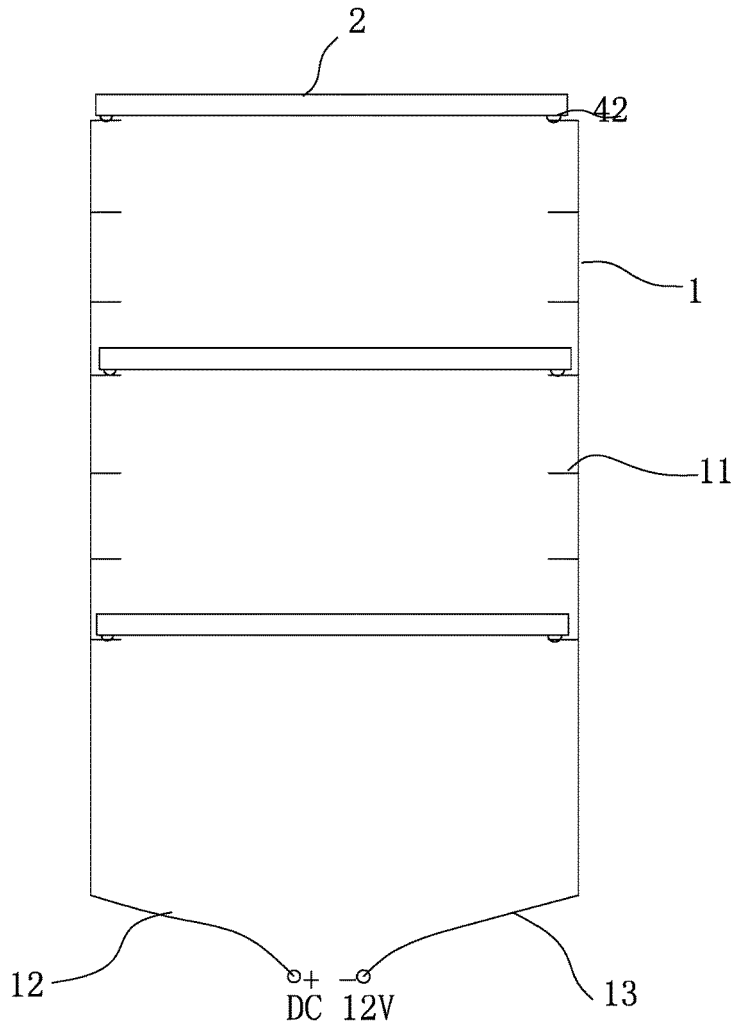
FIG. 1 is a schematic view of a luminous shelf assembly according to an embodiment of the present invention.

REFERENCE NUMERALS luminous shelf assembly 100;

electrical conductive element 1; electrical conductive bar 11; positive wire 12; negative wire 13;

shelf 2; glass plate 21; rear decoration strip 22;

accommodating cavity 221; light hole 2211; first accommodating groove 222; post hole 223;

necking portion 2231;

front decoration strip 23; second accommodating groove 231; silk-screen layer 24;

LED light bar 3; LED light 31; positive power line 32; negative power line 33;

energizing sub-assembly 4; spring 41; touch bead 42;

box-shaped inner container 200; rib groove 210.

DETAILED DESCRIPTION

Embodiments of the present invention will be described below in detail and examples of the embodiments will be illustrated in the accompanying drawings, where same or similar reference numerals are used to indicate same or similar members or members with same or similar functions. The embodiments described below with reference to the accompanying drawings are explanatory, which aim to illustrate the present invention, but shall not be construed to limit the present invention.

In the descriptions of the present invention, it shall be understood that orientation or position relations indicated by terms such as "longitudinal," "lateral," "upper," "lower," "front," "rear," "left," "right," "vertical," "horizontal," "top," "bottom," "inner," and "outer" are the orientation or position relations based on the accompanying drawings, and are only for convenience of description on the present invention and simplifying the descriptions, instead of indicating or implying that the devices or components referred to must have a particular orientation, or be constructed or operated in a particular orientation, and thus shall not be construed to limit the present invention. In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present invention, "a plurality of" means two or more than two, unless specified otherwise.

In the descriptions of the present invention, it shall be noted that unless specified or limited otherwise, the terms "mounted," "connected," "coupled" shall be construed broadly, and may be, for example, fixed connections, detachable connections, or integral connections; may also be mechanical or electrical connections; may also be direct connections or indirect connections via intervening structures; may also be inner communications or interaction of two elements, which can be understood by those skilled in the art according to specific situations.

In the following, a refrigeration apparatus according to embodiments of the present invention will be described firstly with reference to FIG. 7 to FIG. 10, and the refrigeration apparatus may be a refrigerator, a wine cabinet or other similar refrigeration apparatus. In following descriptions of the present application, all illustrations are made by taking an example of the refrigeration apparatus being configured as the refrigerator.

Figure 6:
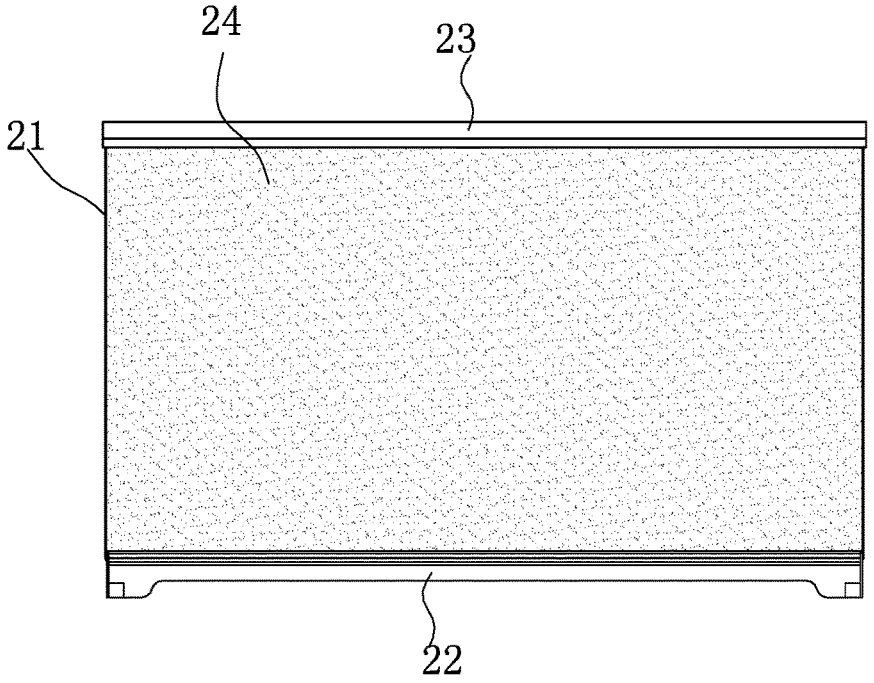
FIG. 6 is a front view of the luminous shelf assembly illustrated in FIG. 1, in which a silk-screen layer is illustrated.
Figure 7:
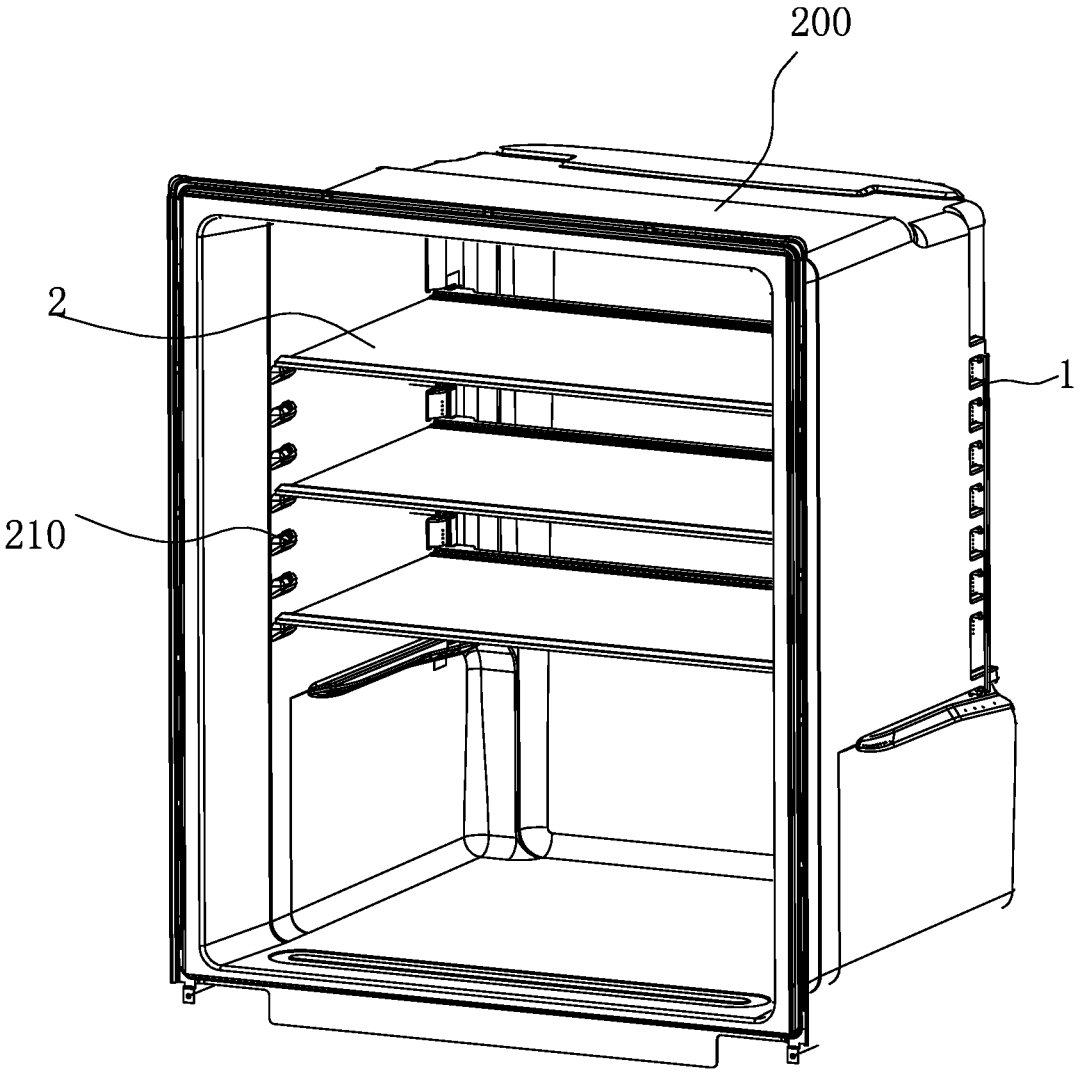
FIG. 7 is a perspective view of a refrigeration apparatus according to embodiments of the present invention.
Figure 8:
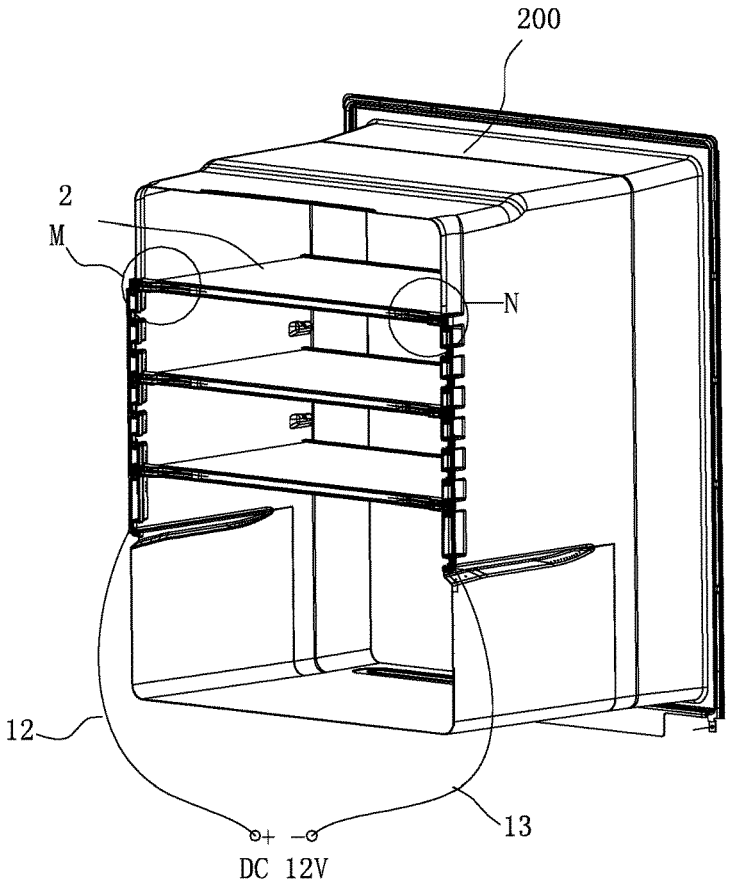
FIG. 8 is a perspective view of the refrigeration apparatus illustrated in FIG. 7 from another angle.

As shown in FIG. 7 and FIG. 8, the refrigeration apparatus includes a box-shaped inner container 200, a luminous shelf assembly 100 disposed in the box-shaped inner container 200, and a door body (not shown in figures). A left side wall and a right side wall of the box-shaped inner container 200 are provided with at least one pair of rib grooves 210, the least one pair of rib grooves 210 are spaced apart from one another in an up and down direction, and each rib groove 210 extends from front to rear. The door body is pivotable with respect to the box-shaped inner container 200 so as to open and close. As for the luminous shelf assembly 100 according to embodiments of the present invention, descriptions thereof will be given below in detail with reference to FIG. 1 to FIG. 6.

The luminous shelf assembly 100 according to the present invention includes two electrical conductive elements 1 extending along a vertical direction, a shelf 2, an LED light bar 3 and two energizing assemblies 4. As shown in FIG. 1, each of the two electrical conductive elements 1 has at least one electrical conductive bar 11 perpendicular thereto and extending towards the other electrical conductive element 1, and the two electrical conductive elements 1 are connected with a positive pole and a negative pole of a power source through a positive wire 12 and a negative wire 13 respectively. Optionally, the power source is controlled by a door light switch (not shown in figures) connected to the door body. Taking the refrigerator as an example, the two electrical conductive elements 1 are disposed at a left end and a right end of a rear side of the box-shaped inner container 200 and extend along a vertical direction, in which a position of the at least one electrical conductive bar 11 is corresponding to the at least one pair of rib grooves 210 respectively, that is, when the shelf 2 is placed on one pair of rib grooves 210, a rear end of the shelf 2 is just corresponding to the position of the electrical conductive bar 11. The position of the shelf 2 can be adjusted by disposing a plurality of pairs of rib grooves 210.

Figure 2A:
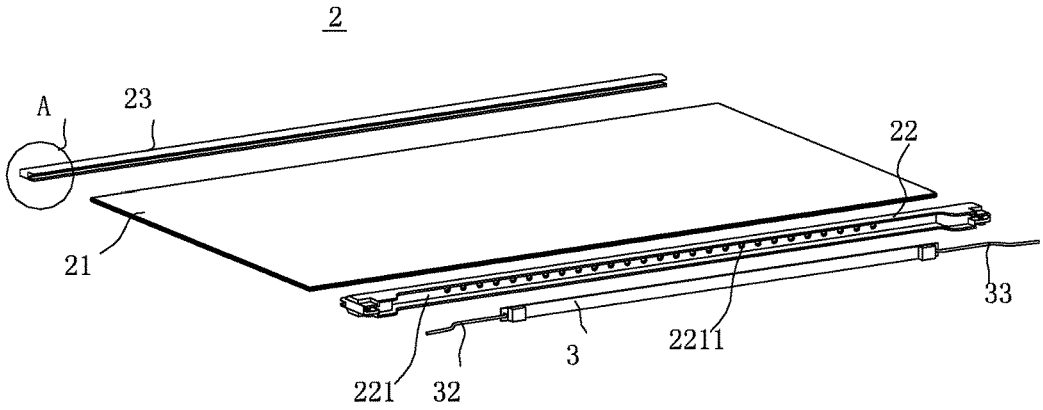
FIG. 2*a* is an exploded view of a shelf in the luminous shelf assembly illustrated in FIG. 1.
Figure 2B:
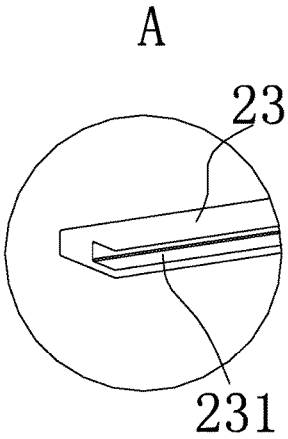
FIG. 2*b* is an enlarged view of portion A circled in FIG. 2*a;*

As shown in FIGS. 2*a*-5*c*, the shelf 2 includes a glass plate 21 and a rear decoration strip 22 disposed at a rear side of the glass plate 21, the rear decoration strip 22 has an accommodating cavity 221 therein, the accommodating cavity 221 has an open rear side, and a front side wall of the accommodating cavity 221 is provided with a plurality of light holes 2211 distributed and spaced apart from one another, as shown in FIG. 2*a*. Optionally, a front end of the rear decoration strip 22 has a first accommodating groove 222 configured to accommodate a rear end of the glass plate 21. Certainly, the present invention is not limited to this, and the front end of the rear decoration strip 22 may be connected with the rear end of the glass plate 21 by sticking.

Figure 3A:
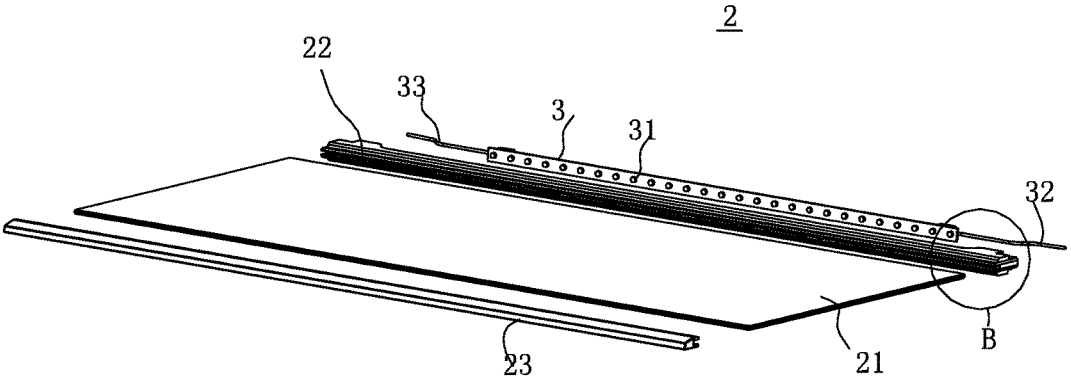
FIG. 3*a* is an exploded view of a shelf in the luminous shelf assembly illustrated in FIG. 1 from another angle.
Figure 3B:
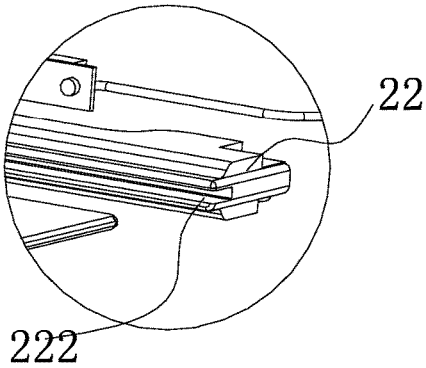
FIG. 3*b* is an enlarged view of portion B circled in FIG. 3*a;*
Figure 4A:
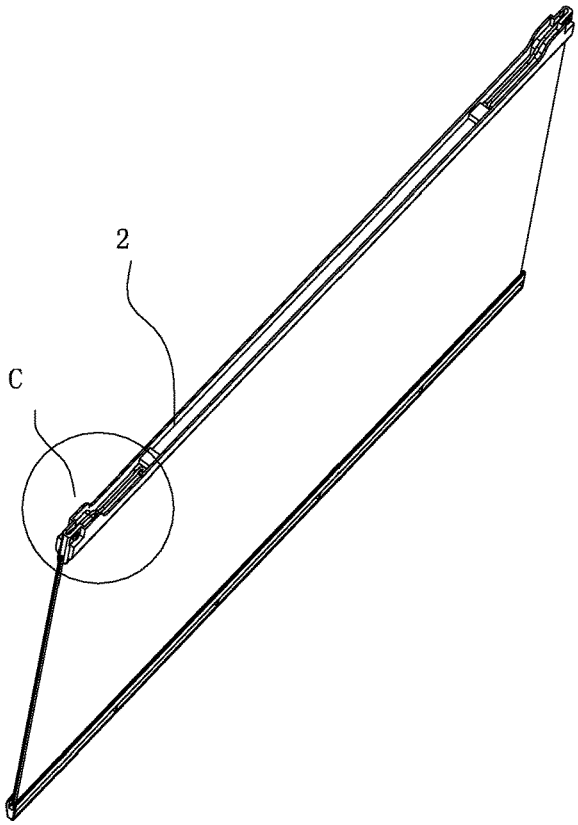
FIG. 4*a* is a perspective view of the luminous shelf assembly illustrated in FIG. 1.
Figure 4B:
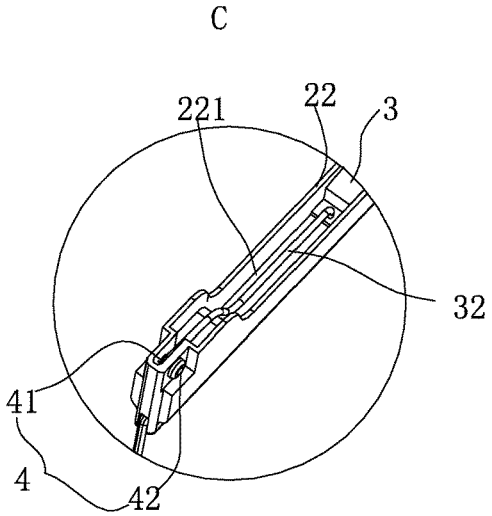
FIG. 4*b* is an enlarged view of portion C circled in FIG. 4*a;*

The LED light bar 3 has a plurality of LED lights 31 corresponding to the plurality of light holes 2211 respectively, the LED light bar 3 is accommodated in the accommodating cavity 221, and positions and sizes of the plurality of light holes 2211 are all matched with those of the LED lights, i.e. each LED light is corresponding to one LED light hole 2211. The LED light bar 3 has a positive power line 32 and a negative power line 33 respectively extending outwards from two ends of the LED light bar 3, as shown in FIG. 3*a*.

The two energizing assemblies 4 are connected to the two ends of the LED light bar 3 and are connected with the positive power line 32 and the negative power line 33 respectively, and the energizing assemblies 4 are configured to electrically connect the positive power line 32 and the negative power line 33 with two electrical conductive bars 11 corresponding to the positive power line and the negative power line in position, respectively. The advantage of the disposition is that, a distance between the two energizing assemblies 4 is very wide, even if there is a large amount of water mist in the box-shaped inner container of the refrigeration apparatus, a short-circuit situation will not appear. Specifically, when the shelf 2 is placed at one pair of rib grooves 210, the rear end of the shelf 2 is corresponding to the position of one corresponding pair of electrical conductive bars 11, and at this time, the positive power line 32 and the negative power line 33 are electrically connected, i.e. conducted with the pair of electrical conductive bars 11 through the energizing assemblies 4, thus making the LED light 31 luminous. Light rays are shined in from the rear side of the glass plate and are refracted repeatedly within the glass plate 21 until being reflected to a front side of the glass plate 21, thus realizing an overall illumination of the shelf 2 and providing sufficient illumination for the entire box-shaped inner container 200.

With the luminous shelf assembly 100 according to embodiments of the present invention, an entire area of the shelf 2 can be illuminated, and the shelf assembly has a simple structure, a convenient installation and a low cost. In addition, when the luminous shelf assembly according to the present invention is used in the refrigeration apparatus, the shelf 2 may be inserted and installed into any pair of rib grooves 210 and conducted with the power source for the electrical conductive elements 1 to obtain a power source supply, and thus the shelf 2 can be lighted up in any position, which is simple, convenient and provides more sufficient illumination.

Preferably, the LED light bar 3 is packaged in the accommodating cavity 221 of the rear decoration strip 22 through a transparent packaging piece (not shown in figures), i.e. all of the electrical components except the energizing sub-assembly 4 are sealed in the transparent packaging piece, thus improving a water resistance and a corrosion resistance of the luminous shelf assembly 100. Optionally, the transparent packaging piece is made from epoxy resin or other transparent packaging materials.

In some optional embodiments, the plurality of LED lights 31 extends out from the plurality of light holes 2211 and is attached to a rear surface of the glass plate 21 respectively. Thus, the LED lights 31 are attached to the rear surface of the glass plate 21, which is convenient for the light rays to shine into the glass plate 21 from the rear side of the glass plate 21.

According to some embodiments of the present invention, the glass plate 21 is configured as a super white glass plate and provided with a silk-screen layer 24 at a lower surface thereof, as shown in FIG. 6, and the silk-screen layer 24 has a white or colorful pattern thereon. Thus, the light rays enter the glass plate 21 from the rear side of the glass plate 21 and are finally shined out of the front side of the glass plate after being reflected and refracted repeatedly. In the process of reflections and refractions, the light rays will be transmitted out from the silk-screen layer 24, thus creating a luminous effect of the silk-screened surface; in addition, a problem of users' fingerprints contaminating the surface of the glass plate 21 is avoided. Optionally, the silk-screen layer is formed by a light-diffusion pigment silk-screened on the lower surface of the glass plate 21, or the silk-screen layer is configured to have a shape of a plurality of grids silk-screened on the lower surface of the glass plate 21. Further, at least one surface of the glass plate 21 is etched into a frosted surface.

Since the super white glass plate has very few metal ions therein, a light transmittance thereof is high, and the light rays have very little attenuation in the glass plate. If the light-diffusion pigment is silk-screened on the lower surface of the glass plate or one or two surfaces of the glass plate is etched into one or two frosted surfaces, the light rays refracted within the glass plate 21 can be scattered out relatively uniformly. In addition, after a frosting treatment is performed on the entire surface of the glass plate 21, even if the glass plate 21 is contaminated with fingerprints, dust or other stains, it is difficult to realize by naked eyes, thus improving aesthetics of the appearance.

As shown in FIG. 2*a* to FIG. 5*a*, in an embodiment of the present invention, the shelf 2 may further include a front decoration strip 23 disposed at a front side of the glass plate 21, thus resulting in a relatively aesthetic appearance. Optionally, a rear end of the front decoration strip 23 has a second accommodating groove 231 configured to accommodate a front end of the glass plate 21. Certainly, the present invention is not limited to this, and the rear end of the front decoration strip 23 may be connected with the front end of the glass plate 21 by sticking.

Certainly, the embodiment described above in which the front decoration strip 23 is provided is optional and the front side of the shelf 2 may be not provided with the front decoration strip 23, so that a part of the light rays in the glass plate 21 may be shined out from the front side of the glass plate 21, thus forming a bright light strip. Further optionally, the shelf 2 may further include at least one of a left decoration strip disposed at a left side of the glass plate 21 and a right decoration strip disposed at a right side of the glass plate 21 (not shown in figures).

The electrical conductive element 1 may be configured as an electrical conductive post or an electrical conductive line. In examples of FIG. 7 to FIG. 10, the electrical conductive element 1 is configured as a vertical metal electrical conductive post, in which a pre-embedded groove (not shown in figures) for the electrical conductive bar is punched in the box-shaped inner container 200 of the refrigeration apparatus by a punching die, and during the foaming of the box-shaped inner container 200, the electrical conductive elements 1 are pre-embedded in the two ends of the rear side of the box-shaped inner container 200. In order to improve the reliability, one electrical conductive element 1 is connected with the positive pole of the power source through the positive wire 12, the other electrical conductive element 1 is connected with the negative pole of the power source through the negative wire 13, and a corresponding voltage is DC 12 V. As shown in FIG. 7 and FIG. 8, the electrical conductive bars 11 penetrate out of a foaming layer from the electrical conductive element 1 in a shape similar to comb teeth and extend out towards an interior of the box-shaped inner container 200, so as to be connected with the energizing assemblies 4, thus conducting the LED lights 31 disposed at the rear side of the shelf 2.

Figure 5A:
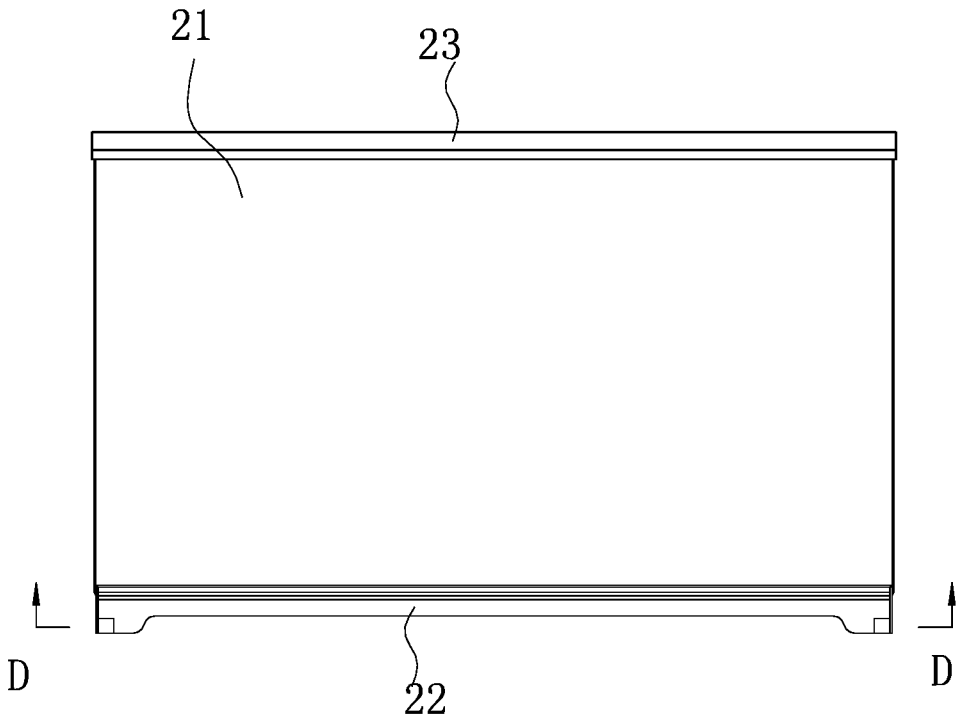
FIG. 5*a* is a front view of the luminous shelf assembly illustrated in FIG. 1.
Figure 5B:
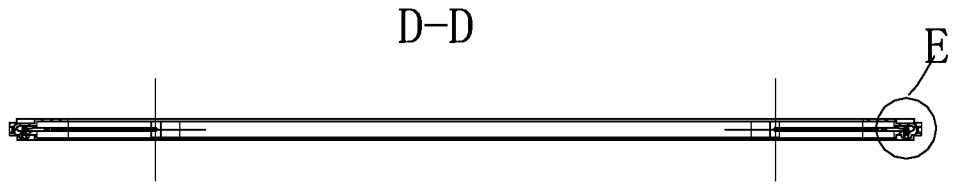
FIG. 5*b* is a section view along direction D-D in FIG. 5*a;*
Figure 5C:
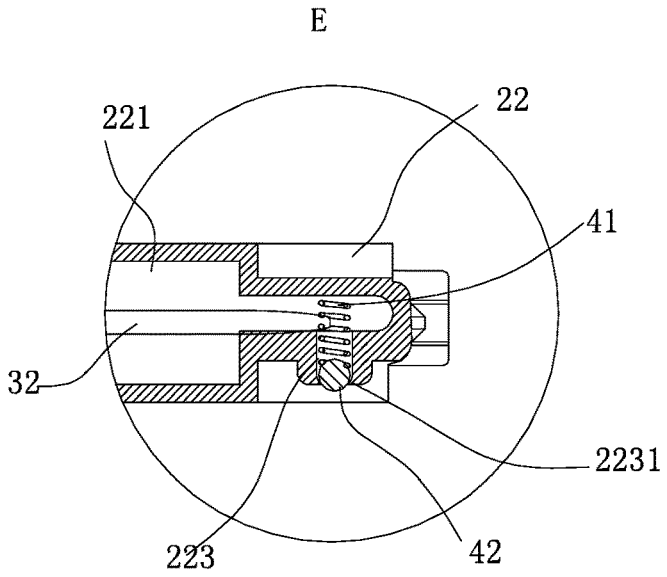
FIG. 5*c* is an enlarged view of portion E circled in FIG. 5*b;*

According to some preferable embodiments of the present invention, as shown in FIG. 4*a* to FIG. 5*c*, each of lower surfaces of left and right ends of the rear decoration strip 22 has a post hole 223, and the post hole 223 has an upper end communicating with the accommodating cavity 221. Each energizing sub-assembly 4 includes a spring 41 and a touch bead 42, and certainly, those skilled in the related art can understand that the spring 41 and the touch bead 42 both are made from electrical conductive materials. As shown in FIG. 5*c*, the spring 41 is accommodated in the post hole 223 and has an upper end abutting against a top wall of the accommodating cavity 221, and the spring 41 is connected with the positive power line 32 or the negative power line 33 located at a corresponding end, i.e. the spring 41 located at a side of the positive power line 32 of the LED light bar 3 is connected with the positive power line 32, and the spring 41 located at a side of the negative power line 33 of the LED light bar 3 is connected with the negative power line 33.

The touch bead 42 is accommodated in the post hole 223, in which the post hole 223 has a necking portion 2231 at a lower end thereof, and a diameter of the necking portion 2231 is less than a diameter of the touch bead 42, so that the spring 41 abuts between the necking portion 2231 and the top wall of the accommodating cavity 221. Thus, due to a function of the spring 41, the touch bead 42 can usually be pushed to a bottom portion of the post hole 223, and a portion of the touch bead 42 is exposed downwards and configured to connect with the corresponding electrical conductive bar 11 so as to be conducted with the power source. However, when the electrical conductive bar 11 applies an upward force to the touch bead 42, the touch bead 42 can move upwards in a single direction. Optionally, the touch bead 42 is a stainless steel bead, a copper ball or a silver-plated steel ball.

Thus, when the energizing sub-assembly 4 electrically touches the electrical conductive bar 11 on the electrical conductive element 1 pre-embedded in the box-shaped inner container 200, the electrical conductive bar 11 presses the touch bead 42 into the post hole 223, and also due to a function of the spring 41, a pressure exists between the touch bead 42 and the electrical conductive bar 11, and thus a reliable electric connection is guaranteed. In addition, the energizing sub-assembly 4 of a spring and touch bead type is adopted, and as the bead can roll, a touch point of the spring and the touch bead is not exclusive, which improves a life of the touch point.

A working process of the luminous shelf assembly 100 according to embodiments of the present invention in the refrigeration apparatus will be described below with reference to FIG. 1 to FIG. 10.

Figure 9:
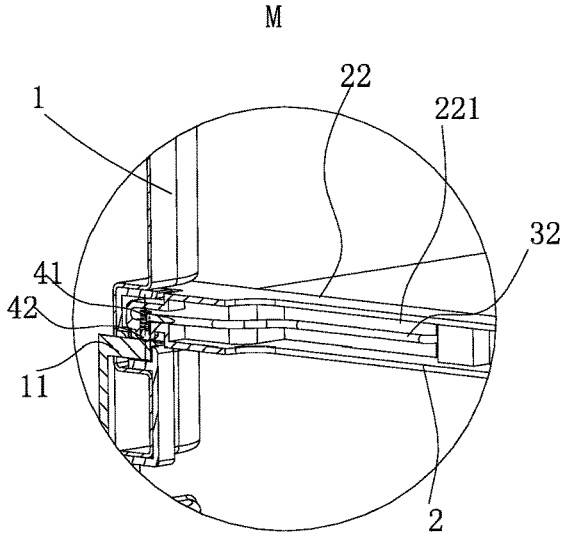
FIG. 9 is an enlarged view of portion M circled in FIG. 8.
Figure 10:
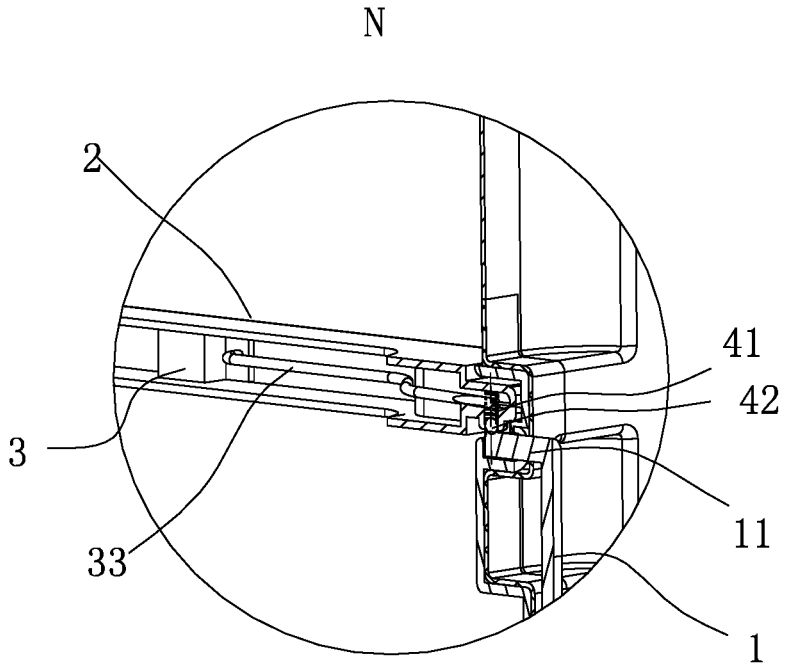
FIG. 10 is an enlarged view of portion N circled in FIG. 8.

As shown in FIG. 7 and FIG. 8, when the shelf 2 is placed in one pair of rib grooves 210, the position of the rear decoration strip 22 at the rear side of the shelf 2 is corresponding to the corresponding pair of electrical conductive strips 11, i.e. the energizing assemblies 4 connected to the rear decoration strip 22 are electrically connected with the electrical conductive strips 11. Specifically, as shown in FIG. 9 and FIG. 10, the touch bead 42 is pressed into the post hole 223 by the electrical conductive bar 11 after touching the electrical conductive bar 11, and also due to a function of the spring 41, a pressure exists between the touch bead 42 and the electrical conductive bar 11, and thus a reliable electric connection among the electrical conductive bar 11, the touch bead 42 and the spring 41 is guaranteed. At the same time, the positive power line 32 and the negative power line 33 of the LED light bar 3 are connected with the springs 41 at the corresponding sides respectively, so that the LED light bar 3 is electrically connected with the electrical conductive elements 1, and thus conduction of the power source for the electrical conductive element 1 can be controlled according to the door light switch (not shown in figures) connected to the door body, thereby realizing the power source supply to the LED light bar, i.e. realizing the illumination of the shelf 2.

When the shelf 2 is moved to another pair of rib grooves 210, the illumination process is the same with that above. In addition, a plurality of shelves 2 may be disposed in the box-shaped inner container 200, so that the plurality of shelves can be lighted up at the same time, and thus the illumination in the box-shaped inner container 200 is more sufficient and free of dead corners.

Other constitutions and operations of the refrigeration apparatus according to embodiments of the present invention are known to those skilled in the related art, which will not be described in detail herein.

Reference throughout this specification to "an embodiment," "some embodiments," "an exemplary embodiment," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples.

Although embodiments of the present invention have been shown and described, it would be appreciated by those skilled in the art that changes, modifications, alternatives and variations in the embodiments can be made without departing from the principle and purpose of the present invention, and the scope of the present invention is defined by the claims and their equivalents.

What is claimed is:

1. A luminous shelf assembly for a refrigerator, comprising:

two electrical conductive elements extending along a vertical direction, each of the two electrical conductive elements having at least one electrical conductive bar perpendicular thereto and extending towards the other electrical conductive element, and the two electrical conductive elements being connected with a positive pole and a negative pole of a power source respectively;

a shelf comprising a glass plate and a rear decoration strip disposed at a rear side of the glass plate, the rear decoration strip having an accommodating cavity therein, the accommodating cavity having an open rear side, and a front side wall of the accommodating cavity being provided with a plurality of light holes distributed and spaced apart from one another;

an LED light bar having a plurality of LED lights corresponding to the plurality of light holes respectively, and the LED light bar being accommodated in the accommodating cavity and having a positive power line and a negative power line respectively extending outwards from two ends of the LED light bar; and two energizing sub-assemblies connected to the two ends of the LED light bar and connected with the positive power line and the negative power line respectively, and the energizing sub-assemblies being configured to electrically connect the positive power line and the negative power line with two electrical conductive bars corresponding to the positive power line and the negative power line in position, respectively, wherein the electrical conductive element is configured as an electrical conductive post, wherein each of lower surfaces of left and right ends of the rear decoration strip has a post hole, and the post hole has an upper end communicating with the accommodating cavity and a lower end; and each energizing sub-assembly comprises:

a spring accommodated in the post hole and having an upper end abutting against a top wall of the accommodating cavity, and the spring being connected with the positive power line or the negative power line located at a corresponding end; and a touch bead accommodated in the post hole, the post hole having a necking portion at the lower end thereof, and a diameter of the necking portion being less than a diameter of the touch bead so that the spring abuts between the necking portion and the top wall of the accommodating cavity.

2. The luminous shelf assembly for the refrigerator according to claim 1, wherein the LED light bar is packaged in the accommodating cavity of the rear decoration strip through a transparent packaging piece.

3. The luminous shelf assembly for the refrigerator according to claim 2, wherein the transparent packaging piece is made from an epoxy resin.

4. The luminous shelf assembly for the refrigerator according to claim 1, wherein the plurality of LED lights extends out from the plurality of light holes and is attached to a rear surface of the glass plate respectively.

5. The luminous shelf assembly for the refrigerator according to claim 1, wherein the glass plate is provided with a silk-screen layer at a lower surface thereof and the silk-screen layer has a white or colorful pattern thereon.

6. The luminous shelf assembly for the refrigerator according to claim 5, wherein the silk-screen layer is formed by a light-diffusion pigment being silk-screened on the lower surface of the glass plate.

7. The luminous shelf assembly for the refrigerator according to claim 5, wherein the silk-screen layer is configured to have a shape of a plurality of grids silk-screened on the lower surface of the glass plate.

8. The luminous shelf assembly for the refrigerator according to claim 1, wherein at least one surface of the glass plate is etched into a frosted surface.

9. The luminous shelf assembly for the refrigerator according to claim 1, wherein a front end of the rear decoration strip has a first accommodating groove configured to accommodate a rear end of the glass plate.

10. The luminous shelf assembly for the refrigerator according to claim 9, wherein the shelf further comprises a front decoration strip disposed at a front side of the glass plate.

11. The luminous shelf assembly for the refrigerator according to claim 10, wherein a rear end of the front decoration strip has a second accommodating groove configured to accommodate a front end of the glass plate.

12. The luminous shelf assembly for the refrigerator according to claim 1, wherein the shelf further comprises at least one of a left decoration strip disposed at a left side of the glass plate and a right decoration strip disposed at a right side of the glass plate.

13. The luminous shelf assembly for the refrigerator according to claim 1, wherein the touch bead is a stainless steel bead, a copper ball or a silver-plated steel ball.

14. A refrigerator, comprising:

a luminous shelf assembly for the refrigerator comprising:

two electrical conductive elements extending along a vertical direction, each of the two electrical conductive elements having at least one electrical conductive bar perpendicular thereto and extending towards the other electrical conductive element, and the two electrical conductive elements being connected with a positive pole and a negative pole of a power source respectively;

a shelf comprising a glass plate and a rear decoration strip disposed at a rear side of the glass plate, the rear decoration strip having an accommodating cavity therein, the accommodating cavity having an open rear side, and a front side wall of the accommodating cavity being provided with a plurality of light holes distributed and spaced apart from one another;

an LED light bar having a plurality of LED lights corresponding to the plurality of light holes respectively, and the LED light bar being accommodated in the accommodating cavity and having a positive power line and a negative power line respectively extending outwards from two ends of the LED light bar; and two energizing sub-assemblies connected to the two ends of the LED light bar and connected with the positive power line and the negative power line respectively, and the energizing sub-assemblies being configured to electrically connect the positive power line and the negative power line with two electrical conductive bars corresponding to the positive power line and the negative power line in position, respectively;

a box-shaped inner container, the luminous shelf assembly being disposed in the box-shaped inner container, a left side wall and a right side wall of the box-shaped inner container being provided with at least one pair of rib grooves, the least one pair of rib grooves being spaced apart from one another in an up and down direction, and each rib groove extending from front to rear, wherein the two electrical conductive elements of the luminous shelf assembly are disposed at a left end and a right end of a rear side of the box-shaped inner container and extend along a vertical direction, a position of the at least one electrical conductive bar corresponds to the at least one pair of rib grooves respectively, and the positive power line and the negative power line of the LED light bar are electrically connected with corresponding electrical conductive bars respectively when the shelf is located in corresponding rib grooves; and a door body pivotable with respect to the box-shaped inner container so as to open and close, wherein the electrical conductive element is configured as an electrical conductive post, wherein each of lower surfaces of left and right ends of the rear decoration strip has a post hole, and the post hole has an upper end communicating with the accommodating cavity and a lower end; and each energizing sub-assembly comprises:

a spring accommodated in the post hole and having an upper end abutting against a top wall of the accommodating cavity, and the spring being connected with the positive power line or the negative power line located at a corresponding end; and a touch bead accommodated in the post hole, the post hole having a necking portion at the lower end thereof, and a diameter of the necking portion being less than a diameter of the touch bead so that the spring abuts between the necking portion and the top wall of the accommodating cavity.

15. The refrigerator according to claim 14, wherein the electrical conductive element is a metal electrical conductive post pre-embedded in the box-shaped inner container.

16. The refrigerator according to claim 15, wherein the power source for the electrical conductive element is controlled by a door light switch connected to the door body.

* * * * *